US007032886B1

(12) United States Patent
Kraft

(10) Patent No.: US 7,032,886 B1
(45) Date of Patent: Apr. 25, 2006

(54) CARPET REMOVAL SYSTEM

(76) Inventor: Eugene P. Kraft, 3410 SE. 47th St., Minot, ND (US) 58701

( * ) Notice: Subject to any disclaimer, the term of this patent is extended or adjusted under 35 U.S.C. 154(b) by 0 days.

(21) Appl. No.: 10/928,990

(22) Filed: Aug. 26, 2004

(51) Int. Cl.
*B25B 25/00* (2006.01)

(52) U.S. Cl. ..... 254/200; 254/202; 254/203; 254/210; 254/213

(58) Field of Classification Search ..... 254/200, 254/202, 203, 205, 206, 208, 210, 212, 213, 254/227
See application file for complete search history.

(56) References Cited

U.S. PATENT DOCUMENTS

| | | | | |
|---|---|---|---|---|
| 416,725 | A * | 12/1889 | Foster | 254/208 |
| 4,332,371 | A | 6/1982 | Bell et al. | 254/203 |
| 4,394,052 | A * | 7/1983 | Adams et al. | 299/18 |
| 4,533,118 | A | 8/1985 | Thomas et al. | 254/202 |
| 4,560,146 | A | 12/1985 | Thomas et al. | 254/202 |
| 4,906,323 | A | 3/1990 | Thomas | 156/584 |
| 4,948,451 | A | 8/1990 | Foltz | 156/344 |
| 5,348,608 | A | 9/1994 | Glenn et al. | 156/344 |
| 5,387,308 | A | 2/1995 | Heavrin | 117/85 |
| 5,454,899 | A | 10/1995 | Glenn et al. | 156/584 |
| 5,456,794 | A | 10/1995 | Barrett | 156/584 |
| 5,505,433 | A * | 4/1996 | Carmichael et al. | 254/211 |
| 5,909,868 | A | 6/1999 | Galella | 254/211 |
| 6,004,426 | A | 12/1999 | Johnson | 156/344 |
| 6,120,238 | A * | 9/2000 | Nickel et al. | 414/787 |
| 6,199,616 | B1 | 3/2001 | Gillespie | 156/584 |
| 6,221,199 | B1 | 4/2001 | Chang et al. | 156/344 |
| 6,227,479 | B1 | 5/2001 | Dean et al. | 242/546.1 |
| 6,371,401 | B1 | 4/2002 | Ketterer | 242/532 |
| 6,386,476 | B1 | 5/2002 | Adleman, Jr. | 242/532.5 |
| 6,455,812 | B1 * | 9/2002 | Houle | 219/228 |
| 6,613,188 | B1 | 9/2003 | Berg et al. | 156/344 |
| 6,832,751 | B1 * | 12/2004 | Shannon | 254/202 |
| 6,840,299 | B1 * | 1/2005 | Allen et al. | 156/584 |

* cited by examiner

*Primary Examiner*—Kathy Matecki
*Assistant Examiner*—Evan H. Langdon

(57) ABSTRACT

A carpet removal system for efficiently removing carpeting. The carpet removal system includes a winch, a base member with a plurality of base teeth attached to the base member, an engaging member with a plurality of engaging teeth, and a cable extending from the winch for connecting to the engaging member. The base teeth and the engaging teeth are capable of catchably engaging the carpet to be removed. The engaging member is attached to an end of the carpet to be removed and the winch is positioned near an opposite position upon the carpet. The winch is operated to cause the engaging member to be drawn towards the winch thereby causing the carpet to be removed from the floor.

1 Claim, 7 Drawing Sheets

CARPET REMOVAL SYSTEM

CROSS REFERENCE TO RELATED APPLICATIONS

Not applicable to this application.

STATEMENT REGARDING FEDERALLY SPONSORED RESEARCH OR DEVELOPMENT

Not applicable to this application.

BACKGROUND OF THE INVENTION

1. Field of the Invention

The present invention relates generally to carpet removal devices and more specifically it relates to a carpet removal system for efficiently removing carpeting.

2. Description of the Related Art

Carpet removal devices have been in use for years. Because manual removal of carpet that used a glue or adhesive to secure to the floor required a high amount of physical exertion, devices were developed to lessen the amount of physical exertion necessary to perform carpet removal. Typically, carpet removers needed to use something with a flat sharpened surface to remove the adhesively attached portion of the carpet by forcing the tool between the carpet and the underlying surface. This produced a large stress on peoples' back, shoulders, and arms.

A problem with prior art was that carpet would often need to be taken out in small strips. Because of the requisite force to remove large pieces of carpet, it was virtually impossible for an individual to produce enough force to remove carpet in increment strips larger than eighteen to twenty-four inches at a time, effectively slowing the process to a snail's pace.

Although devices have been developed to do remove carpet using motors to reduce the manual physical stress associated with carpet removal. A problem with these devices was that some sort of anchor or other system was necessary to keep the motor in place.

Another problem with the prior art was that in order to secure the carpet to the device, a person would have to start tearing out a small portion of the carpet, in essence to get things started. Although it was not a large portion of carpet required to get things started, the corners are often some of the hardest portions to remove. Manually tearing out corners of adhesively fastened carpet requires a great amount of force and physical exertion because a person must bend over, get a solid grasp on the corner of the carpet, and use an awkward jerking motion just to get the carpet removal "started."

While these devices may be suitable for the particular purpose to which they address, they are not as suitable for efficiently removing carpeting. Conventional carpet removal devices are labor intensive and can be bulky to transport.

In these respects, the carpet removal system according to the present invention substantially departs from the conventional concepts and designs of the prior art, and in so doing provides an apparatus primarily developed for the purpose of efficiently removing carpeting.

BRIEF SUMMARY OF THE INVENTION

In view of the foregoing disadvantages inherent in the known types of carpet removal devices now present in the prior art, the present invention provides a new carpet removal system construction wherein the same can be utilized for efficiently removing carpeting.

The general purpose of the present invention, which will be described subsequently in greater detail, is to provide a new carpet removal system that has many of the advantages of the carpet removal devices mentioned heretofore and many novel features that result in a new carpet removal system which is not anticipated, rendered obvious, suggested, or even implied by any of the prior art carpet removal devices, either alone or in any combination thereof.

To attain this, the present invention generally comprises a winch, a base member with a plurality of base teeth attached to the base member, an engaging member with a plurality of engaging teeth, and a cable extending from the winch for connecting to the engaging member. The base teeth and the engaging teeth are capable of catchably engaging the carpet to be removed. The engaging member is attached to an end of the carpet to be removed and the winch is positioned near an opposite position upon the carpet. The winch is operated to cause the engaging member to be drawn towards the winch thereby causing the carpet to be removed from the floor.

There has thus been outlined, rather broadly, the more important features of the invention in order that the detailed description thereof may be better understood, and in order that the present contribution to the art may be better appreciated. There are additional features of the invention that will be described hereinafter and that will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of the description and should not be regarded as limiting.

A primary object of the present invention is to provide a carpet removal system that will overcome the shortcomings of the prior art devices.

A second object is to provide a carpet removal system for efficiently removing carpeting.

Another object is to provide a carpet removal system that does not require an independent anchor or pulley system to secure itself to.

An additional object is to provide a carpet removal system that reduces the amount of physical labor required to remove carpet that is adhesively attached to a floor.

A further object is to provide a carpet removal system that is relatively compact in size and easy to transport.

Another object is to provide a carpet removal system that can be operated by most individuals.

Other objects and advantages of the present invention will become obvious to the reader and it is intended that these objects and advantages are within the scope of the present invention.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

DETAILED DESCRIPTION OF THE INVENTION

A. Overview

Figure 1:
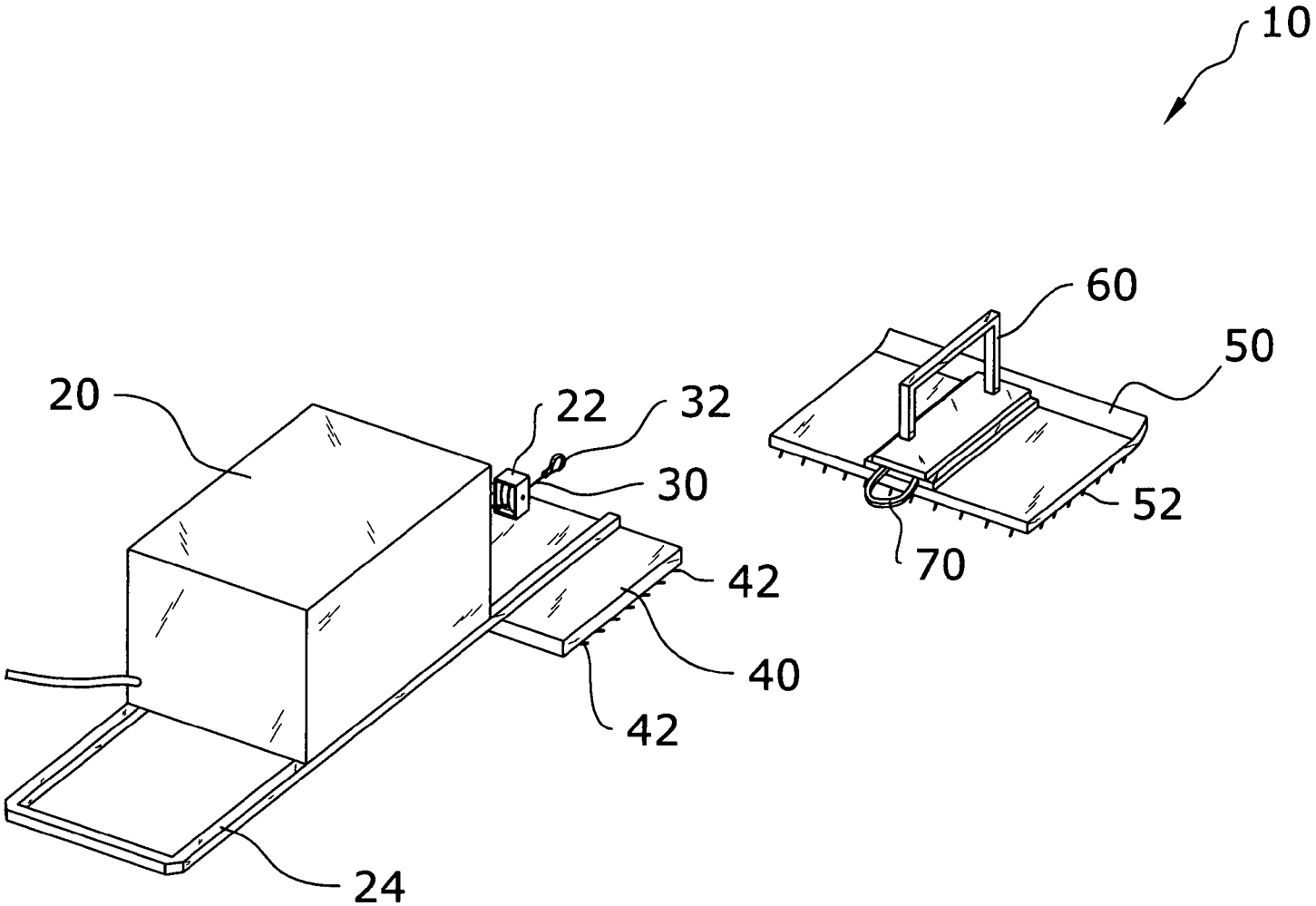
FIG. 1 is an upper perspective view of the present invention.

Turning now descriptively to the drawings, in which similar reference characters denote similar elements throughout the several views, FIGS. 1 through 7 illustrate a carpet removal system 10, which comprises a winch 20, a base member 40 with a plurality of base teeth 42 attached to the base member 40, an engaging member 50 with a plurality of engaging teeth 52, and a cable 30 extending from the winch 20 for connecting to the engaging member 50. The base teeth 42 and the engaging teeth 52 are capable of catchably engaging the carpet 12 to be removed. The engaging member 50 is attached to an end of the carpet 12 to be removed and the winch 20 is positioned near an opposite position upon the carpet 12. The winch 20 is operated to cause the engaging member 50 to be drawn towards the winch 20 thereby causing the carpet 12 to be removed from the floor 14.

B. Winch

The winch 20 includes at least one cable 30 retractably extending from the winch 20 as shown in FIGS. 1, 2, 5, 6 and 7 of the drawings. The winch 20 is preferably electrically powered by an electric motor, however other power sources may be utilized to provide power to said winch 20. The winch 20 may have various power ratings that are capable of drawing the cable 30 and the carpet 12. The winch 20 may be operated utilizing conventional controls that allow for the controlling of the drawing or extension of the cable 30 from the winch 20.

Figure 2:
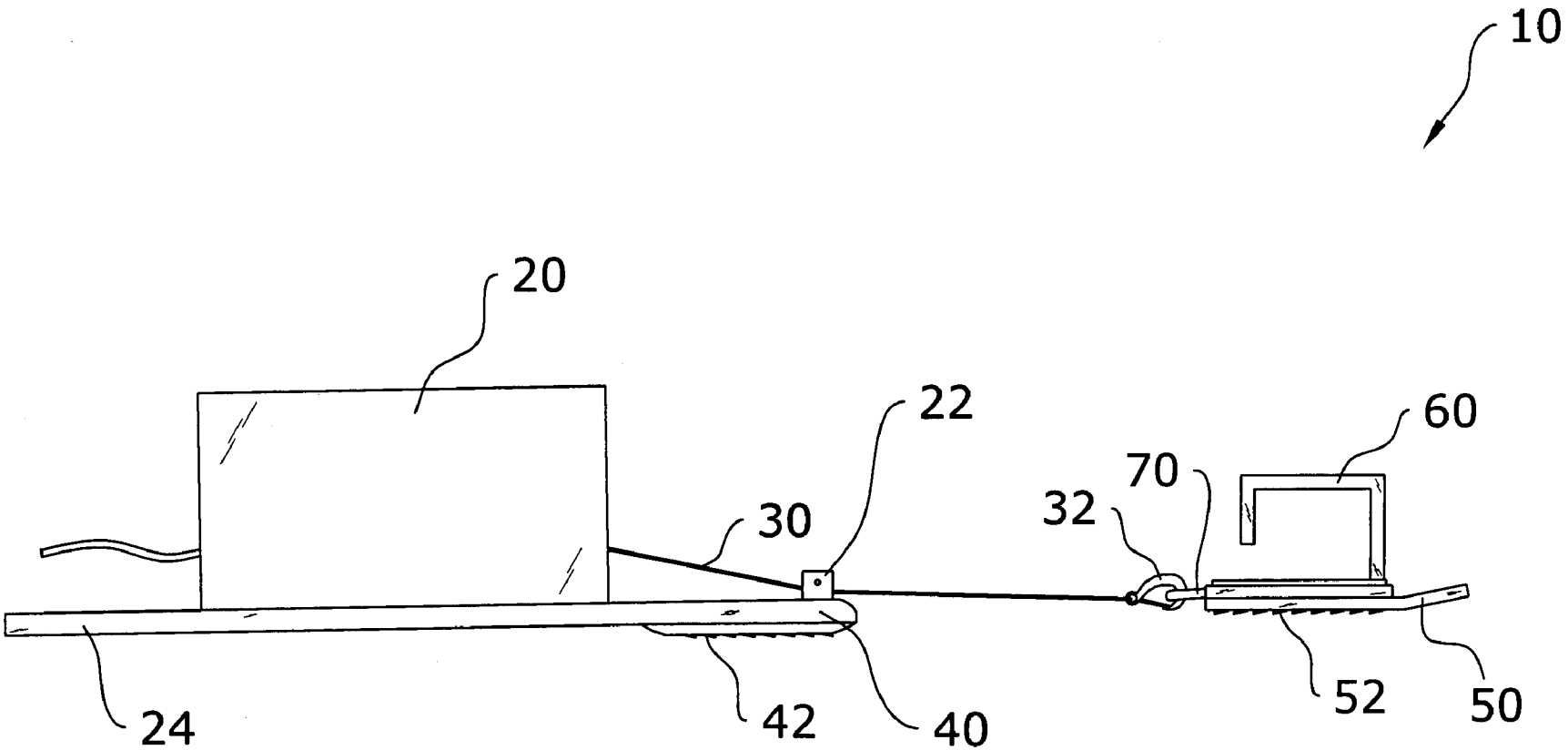
FIG. 2 is a side view of the present invention connected together.

As best illustrated in FIGS. 1 and 2 of the drawings, the winch 20 preferably includes at least one guide pulley 22 that guides the cable 30 near the carpet 12 when exiting the winch 20. The guide pulley 22 is preferably positioned at the front end of the winch 20 such as to the frame 24 as shown in FIG. 2 of the drawings.

The cable 30 may be comprised of a metal or fiber rope structure. The cable 30 may have various lengths sufficient to connect to the engaging member 50 within a room. The cable 30 preferably includes a first connector 32 (e.g. hook, clasp, fastener) for selectively and removably connecting to the engaging member 50 as shown in FIG. 1 of the drawings. It can be appreciated that the distal portion of the cable 30 may be permanently attached to the engaging member 50 utilizing conventional fasteners.

The winch 20 preferably includes a frame 24 forming a handle structure as shown in FIG. 1 of the drawings. The frame 24 preferably extends rearwardly from the winch 20 to form a loop structure that may be easily grasped by a user.

C. Base Member

Figure 3:
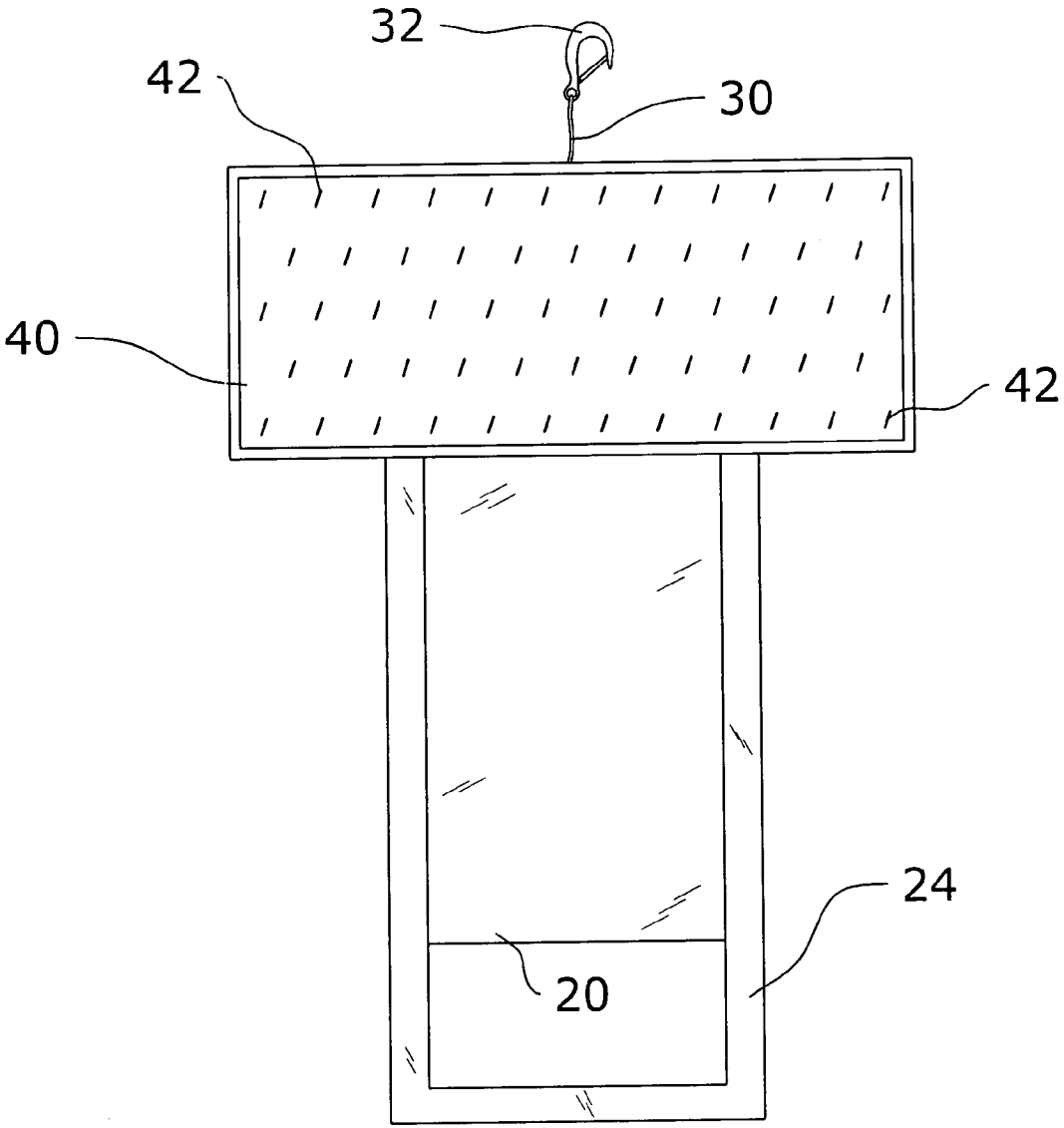
FIG. 3 is a bottom view of the winch.
Figure 4:
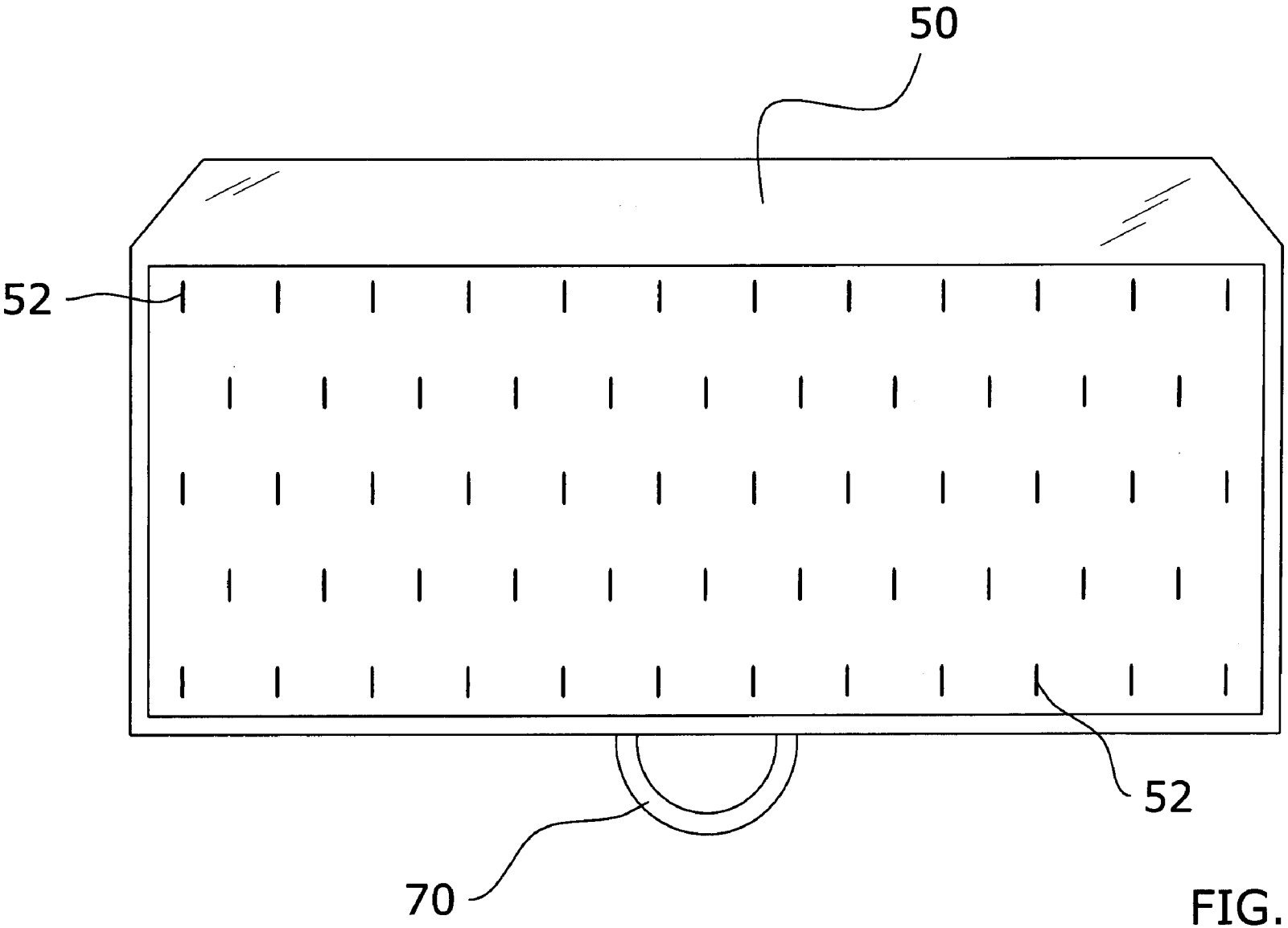
FIG. 4 is a bottom view of the engaging member.

A base member 40 is preferably attached to the winch 20 as shown in FIGS. 1 through 3 of the drawings. The base member 40 is preferably comprised of a plate structure, however various other structures may be utilized for the base member 40.

A plurality of base teeth 42 preferably extend from a lower surface of the base member 40 as best illustrated in FIG. 2 of the drawings. The base teeth 42 preferably extend forwardly and downwardly at an angle from the base member 40 as further shown in FIG. 2. The forward and downward angle of the base teeth 42 assist in gripping the carpet 12 when a drawing force is applied to the engaging member 50 thereby preventing movement of the winch 20 during the removal of the carpet 12 from the floor 14. The base member 40 is preferably attached to a front portion of the winch 20, however various other locations upon the winch 20 may be utilized.

D. Engaging Member

Figure 5:
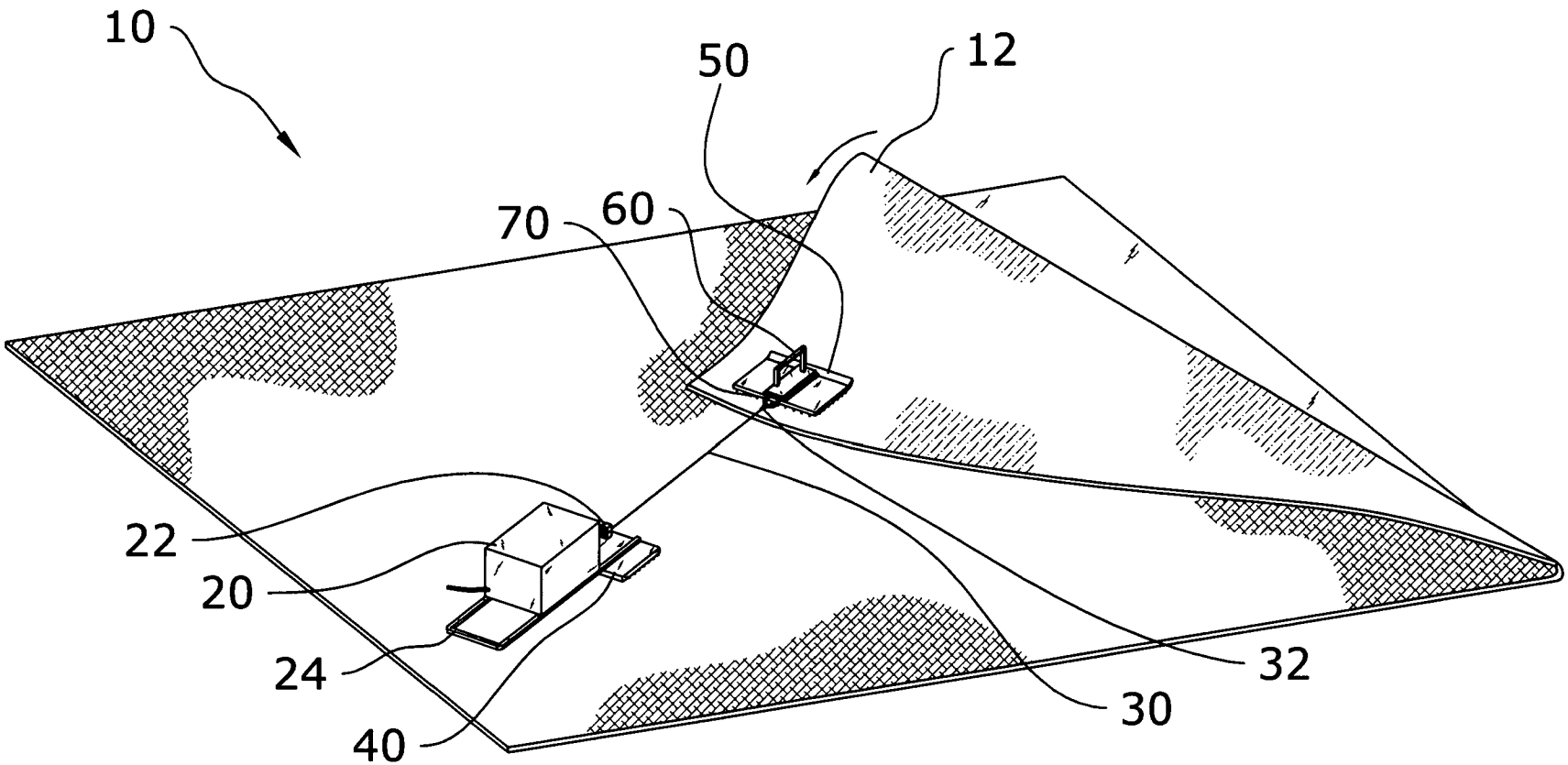
FIG. 5 is an upper perspective view of the present invention removing carpet from a floor.

The engaging member 50 is connectable to a distal portion of the cable 30 as shown in FIGS. 2 and 5 of the drawings. The engaging member 50 is preferably comprised of a plate structure, however various other configurations may be utilized to construct the engaging member 50.

A plurality of engaging teeth 52 preferably extend from a lower surface of the engaging member 50 as shown in FIG. 2 of the drawings. The engaging teeth 52 preferably extend rearwardly and downwardly at an angle from the engaging member 50 as further shown in FIG. 2 of the drawings. The rearward and downward angle of the engaging teeth 52 assist in gripping the carpet 12 when a drawing force is applied to the engaging member 50 thereby preventing movement of the engaging member 50 with respect to the carpet 12 during the removal of the carpet 12 from the floor 14.

The engaging member 50 preferably includes a second connector 70 that is engageable with the first connector 32 of the cable 30. The second connector 70 may be comprised of various fastener structures such as a loop. The base teeth 42 and the engaging teeth 52 preferably have pointed ends for easily penetrating the carpet 12 (including the backing of the carpet 12).

The engaging member 50 preferably includes at least one handle member 60 as shown in FIGS. 1 and 2 of the drawings. The handle member 60 may have various structures and configurations for providing easy manipulation of the engaging member 50 by a user.

E. Operation of Invention

To use the present invention, a first portion (e.g. corner portion) of the carpet 12 is first removed from the floor 14. The first portion is typically removed utilizing a manual method and manual tools conventionally utilized by carpet 12 removers. After the first portion is removed, the first portion is thereafter folded over the remaining portion of the carpet 12 thereby exposing the lower surface of the first portion as show in FIGS. 5 and 6 of the drawings.

The user then attaches the winch 20 to the carpet 12 a distance away from the first portion, wherein the distance from the first portion is determined by the length of carpet 12 desired to be removed. To attach the winch 20 to the upper surface of the carpet 12, the base teeth 42 are positioned upon the upper surface of the carpet 12. When the winch 20 is initially operated, the drawing force will cause the base teeth 42 to penetrate the carpet 12 in a catchable manner.

Figure 6:
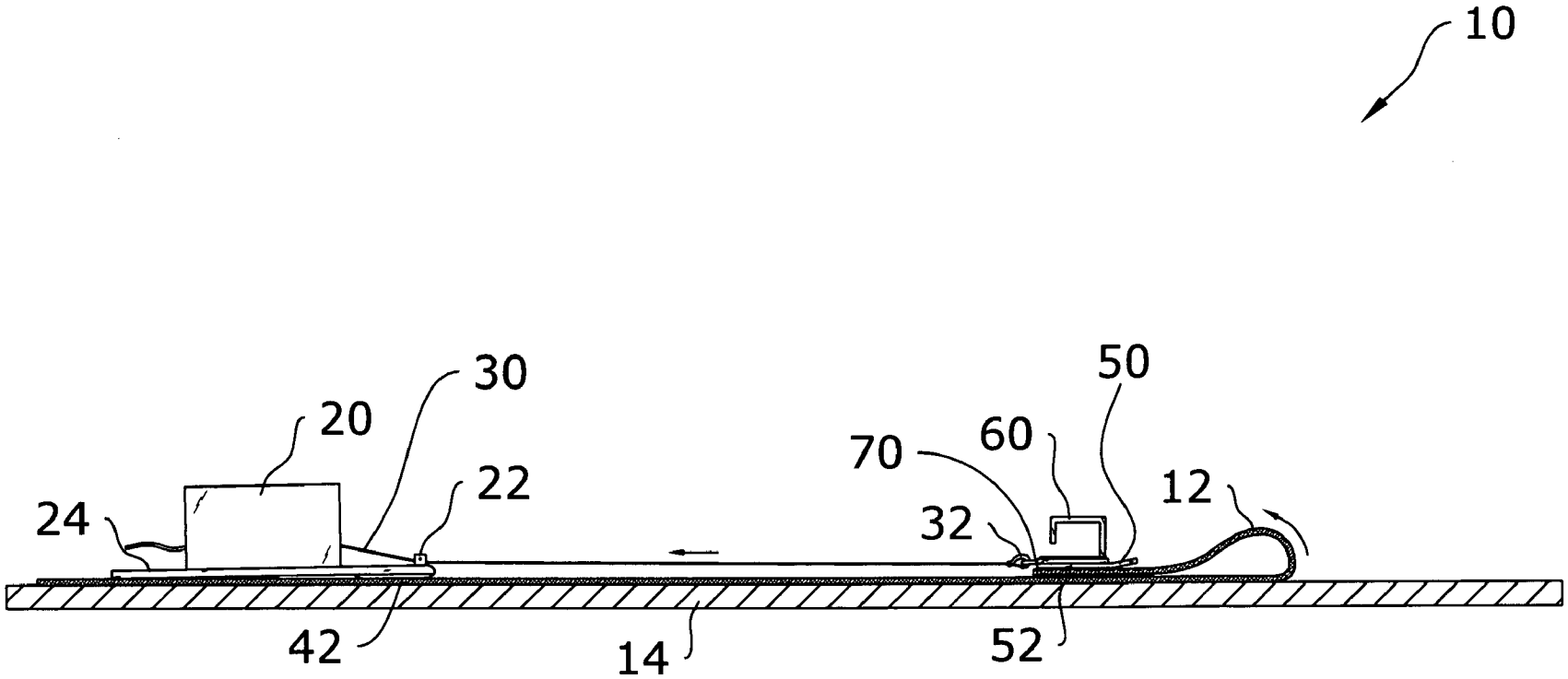
FIG. 6 is a side view of the present invention removing carpet from a floor initially.

The user then attaches the engaging member 50 to the exposed lower surface of the first portion of the carpet 12 as shown in FIGS. 5 and 6 of the drawings. To attach the engaging member 50 to the lower surface (i.e. backing) of the carpet 12, the engaging teeth 52 are positioned upon the lower surface and then the engaging member 50 is forced rearwardly causing the engaging teeth 52 to penetrate the carpet 12. The cable 30 is then connected to the engaging member 50 as shown in FIGS. 5 and 6 of the drawings.

Figure 7:
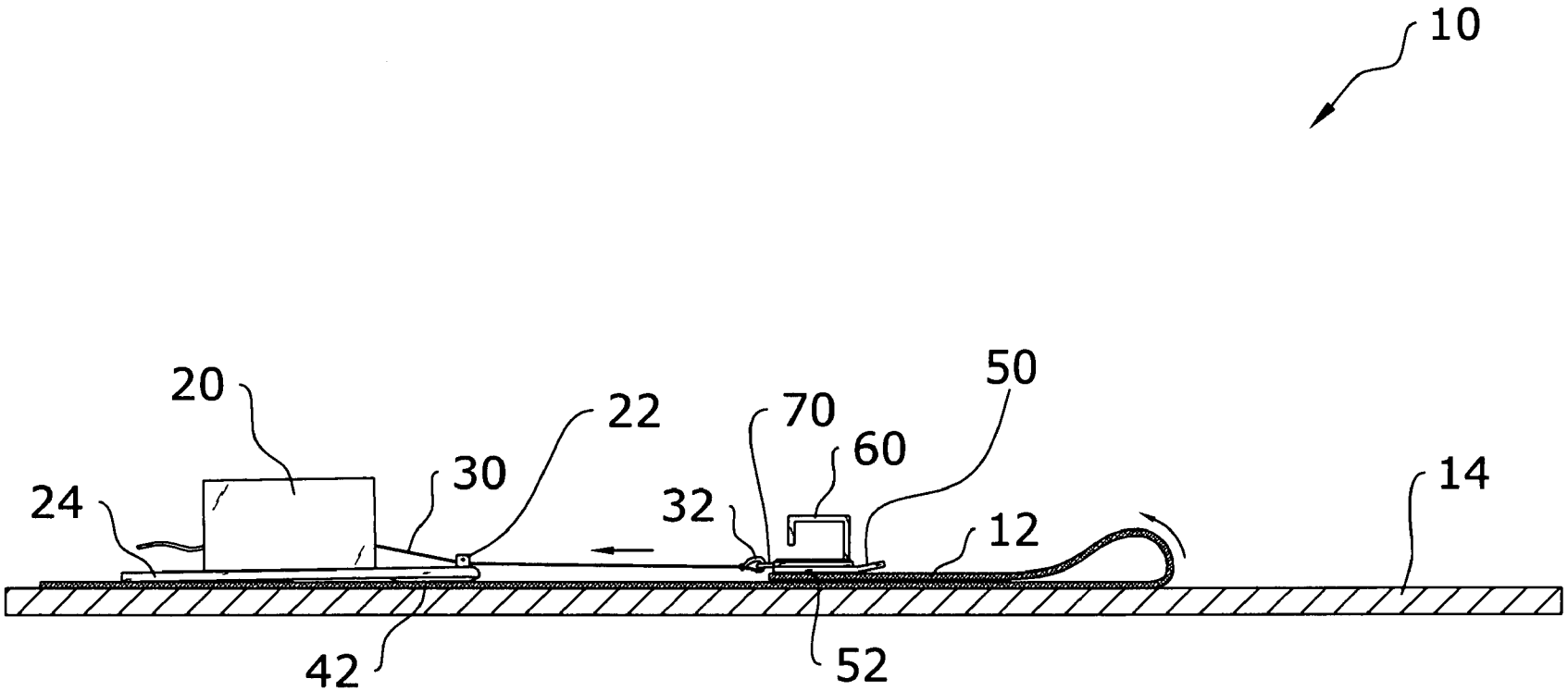
FIG. 7 is a side view of the present invention removing carpet from a floor.

After the cable 30 is connected between the winch 20 and the engaging member 50, the user then manipulates the winch 20 to cause the winch 20 to draw the cable 30 into the winch 20 as shown in FIGS. 6 and 7 of the drawings. Drawing the cable 30 towards the winch 20 causes the remaining portion of the carpet 12 to be removed from the floor 14 as shown in FIGS. 6 and 7 of the drawings. When the cable 30 is drawn towards the winch 20, the carpet 12 is "rolled" over upon itself creating a lifting force that removes the adhesively attached carpet 12 from the floor 14 as best illustrated in FIG. 7 of the drawings. This process continues until the carpet 12 is removed. It can be appreciated that as the drawing force is applied by the winch 20 that the base teeth 42 and the engaging teeth 52 extend further into the carpet 12 to prevent movement of the winch 20 and the engaging member 50 with respect to the carpet 12.

What has been described and illustrated herein is a preferred embodiment of the invention along with some of its variations. The terms, descriptions and figures used herein are set forth by way of illustration only and are not meant as limitations. Those skilled in the art will recognize that many variations are possible within the spirit and scope of the invention, which is intended to be defined by the following claims (and their equivalents) in which all terms are meant in their broadest reasonable sense unless otherwise indicated. Any headings utilized within the description are for convenience only and have no legal or limiting effect.

I claim:

1. A method of removing carpet from a floor, said method comprising the steps of:

removing a first portion of a carpet from a floor;

folding said first portion over a remaining portion of said carpet thereby exposing a lower surface of said first portion of said carpet;

attaching a winch to said carpet a distance away from said first portion;

attaching an engaging member to only said lower surface of said first portion of said carpet;

connecting a cable from said winch to said engaging member; and operating said winch to draw said cable towards said winch thereby causing said remaining portion of said carpet to be removed from said floor.

* * * * *